US005957604A

United States Patent [19]

Anderson

[11] Patent Number: 5,957,604

[45] Date of Patent: Sep. 28, 1999

[54] STRUCTURALLY REINFORCED CRAYONS

[76] Inventor: Richard A. Anderson, 2605 SW. Third, Ankeny, Iowa 50021

[21] Appl. No.: 08/707,098

[22] Filed: Sep. 3, 1996

[51] Int. Cl.[6] ..... B43K 19/14

[52] U.S. Cl. ..... 401/96; 401/88; 401/192; 40/334

[58] Field of Search ..... 401/96, 88, 192; 40/334

[56] References Cited

U.S. PATENT DOCUMENTS

| | | | |
|---|---|---|---|
| 1,830,102 | 11/1931 | Felsenthal | 40/334 |
| 2,205,907 | 6/1940 | Oxley | 401/88 |
| 2,586,765 | 2/1952 | Onkey | 401/96 |
| 3,249,092 | 5/1966 | Moojen | 401/88 |
| 4,386,125 | 5/1983 | Shiraki et al. | 428/36 |
| 4,413,921 | 11/1983 | Fotiu et al. | 401/96 |
| 4,423,584 | 1/1984 | Elsner et al. | 53/415 |
| 4,640,636 | 2/1987 | Hofmann | 401/96 |
| 5,039,243 | 8/1991 | O'Brien . | |
| 5,112,151 | 5/1992 | Collignon | 401/96 |
| 5,460,878 | 10/1995 | Hostetter | 428/349.1 |
| 5,522,960 | 6/1996 | Rello et al. | 156/215 |

FOREIGN PATENT DOCUMENTS

| | | | |
|---|---|---|---|
| 695358 | 12/1930 | France | 401/96 |

*Primary Examiner*—Steven A. Bratlie
*Attorney, Agent, or Firm*—Zarley, McKee, Thomte, Voorhees & Sease

[57] ABSTRACT

A structurally reinforced crayon that has a core of crayon material and a surrounding sheath of flexible and cuttable material that structurally reinforces the crayon material to prevent premature breakage.

1 Claim, 1 Drawing Sheet

STRUCTURALLY REINFORCED CRAYONS

BACKGROUND OF THE INVENTION

This invention relates to crayons. Crayons, as those with children well know, are coloring instruments usually cylindrically shaped with a pointed end and used by children for writing, drawing, coloring, etc. There are many manufacturers of such crayons. Most make them from well-known wax or waxy-type materials, either natural or synthetic in origin. Some of the more prominent crayon manufacturers include Binny & Smith, Rose Art, and a most recent entries such as Milton Bradley, Pentel Company and others. Crayons are usually designed for children in an age range of from about four years old to about nine years old.

Of course, crayons are easy for a child to use and draw with because of their size, because of the vivid colors, and because of their safety, i.e they lack blunt, sharp points or the strong integrity that allow them to be used as a punching projectile. At the same time, these same features, particularly the safety features that allow them to not be instruments of harm, cause some use problems. The most common problem is premature breakage.

Premature breakage as used here refers to the common problem of crayons breaking as the child uses them. Typically, small children that first begin use of writing instruments, such as pens, pencils, crayons and the like use an extraordinarily high amount of pressure in applying the writing instrument to the paper. As a result, crayons are often prematurely broken, well prior to the normal end of the useful life of the crayon. It is not uncommon for such premature breakage to occur within days of purchase of an entire package of crayons. The result is a box of short, diminutive, and often crumbled crayons that are rejected by children. Thus, even though the crayons have not even closely approached the normal end of their useful life, their useful life in fact ends because they have been broken.

This invention has as its primary objective the development of a crayon that is structurally reinforced so that it can be used by a child, even with excessive pressure against the writing paper, with minimization of premature breakage risk.

Another objective of the present invention is to provide a combination structure of a conventional crayon material and a reinforcing sheath which reinforces the structural integrity of the crayon, but at the same time does not interfere with the ability to use or sharpen the crayon.

A further objective of the present invention is to provide a method of structurally reinforcing crayons without increasing their danger risk of improper use as a blunt instrument.

These and other additional objectives, features and advantages of the invention can be seen with reference to the accompanying specification, summary of the invention, and drawings, all of which are relied upon for full disclosure of the invention.

SUMMARY OF THE INVENTION

A structurally reinforced crayon that has a core of crayon material and a surrounding sheath of flexible and cuttable material that structurally reinforces the crayon material to prevent premature breakage.

The invention also relates to particular materials used for the reinforcing sheath and to a method of manufacturing of the structurally reinforced crayons.

DETAILED DESCRIPTION OF THE PREFERRED EMBODIMENT

Figure 1:
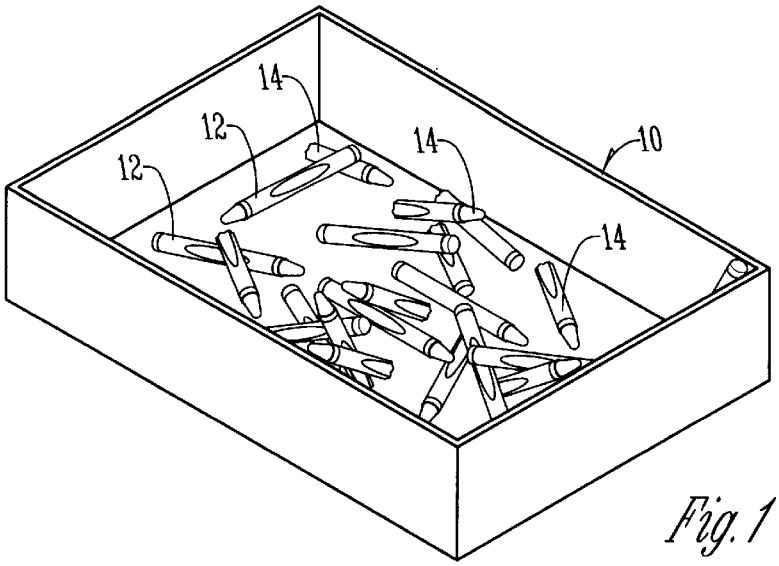
Fig.1 (Prior Art)
FIG. 1 is a representation of the prior art showing in perspective view a box of crumbled and broken crayons.

In reference to the drawings, and particularly FIG. 1, there is shown a box 10 of crayons 12, many of which are prematurely broken 14. Children, of course, do not wish to use prematurely broken crayons 14, and instead on a free choice basis select only the full-length crayons. When there are no more full-length crayons 12, the child often discards them and asks for a new box. The result is premature breakage and premature turnover requiring the parent to purchase a new box, earlier than they otherwise might have to.

It has now been found that there is a way to structurally reinforce conventional crayons without the need to significantly modify the material of which the crayons are made, and without significantly increasing the hazard risk to the child-user of the crayons. This is, of course, extremely important because any way of increasing strength that would make the crayon itself a blunt instrument and projectile, capable of for example causing eye puncture wounds is not satisfactory. Thus, the amount of integrity offered to the crayon must be an amount sufficient to increase its life as a writing instrument, but not so much as to increase its hazard risk as an instrument for harm. This invention provides that unique blend of compatibilities.

Figure 2:
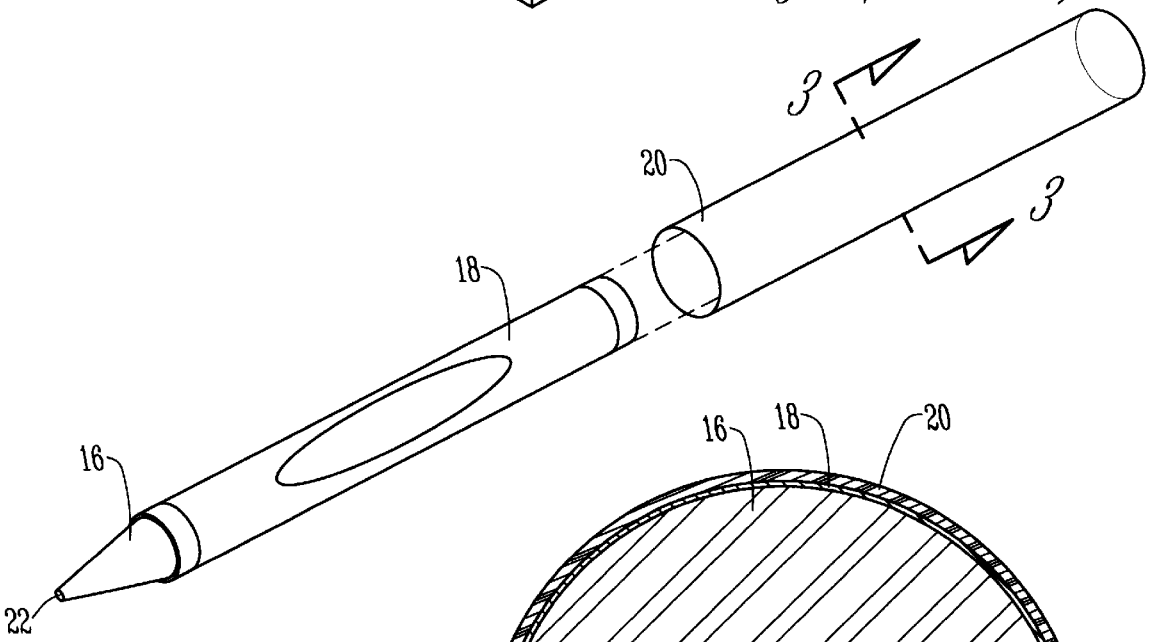
FIG. 2 is an exploded view in perspective showing a conventional crayon and the reinforcing sheath of the invention.
Figure 3:
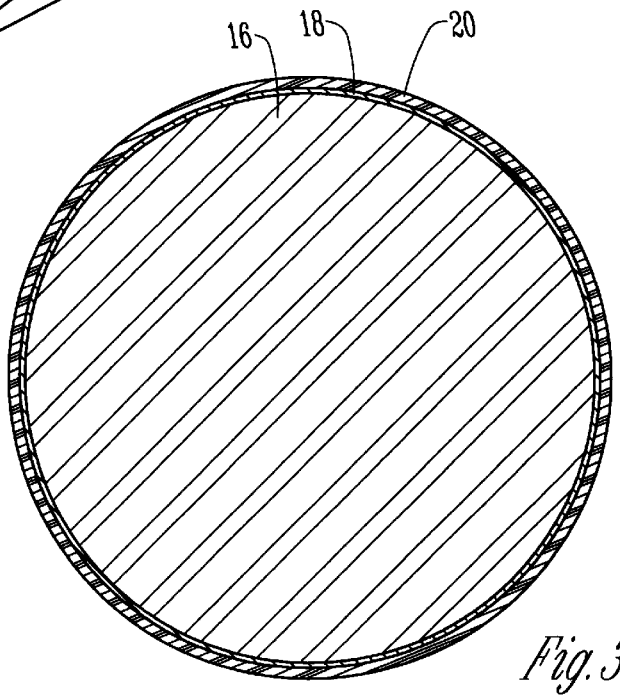
FIG. 3 is a sectional view along line 3—3 of FIG. 2, assuming that the sheath is in fact upon the crayon.

Looking at FIG. 2 there is provided a core of crayon material, usually a waxy crayon material containing natural waxes, pigments, etc. 16. This core material is usually shaped in a cylindrical fashion, much like a pencil, as illustrated in FIG. 2. Surrounding the core of the crayon material is a label 18, usually of paper material. Paper label 18 surrounds the crayon core 16 in mating relationship, and usually has some decorative printing thereon as well as writing indicia indicating the color of the crayon. As it known and proven by current commercial usage, paper label 18 is not of sufficient structural integrity to provide any enhanced integrity of the combination of the crayon core and the paper label. Put another way, it breaks nearly as easily as the crayon core itself.

In accordance with the present invention, structurally reinforcing sheath 20 is of a flexible and cuttable material, and matingly surrounds the crayon core 16 and, if used its paper label 18, in close interrelationship. In fact, it provides structural integrity to the crayon core 16 so that its structural integrity exceeds the normally applied forces by a child. As a result, a crayon, even with the excessive force used by an inexperienced child in first attempts at writing, does not exceed the forces normally required to break the crayon. At the same time, the surrounding flexible and cuttable sheath material 20 is of such a nature that it can be conventionally inserted into a sharpener for the crayon and cut to provide a crayon core point 22 without any interference with the sharpening process. In other words, it can be cut and shaped just like a conventional paper label 18.

Crayon 12 is of conventional crayon material, often colored wax. It can also be colored chalk or colored clay according to known compositions and methods used in the art. It can be made in virtually any color of the color spectrum and usually is of non-toxic meltable materials, for obvious reasons.

In addition to the basic wax and coloring components, the crayon 12 may contain conventional plasticizers, moisturizers, stiffening agents, for instance glycerol, sorbitol, mannitol, polyethylene glycol, odorents, and dyes and pigments. For more details of compositional components of conventional crayons, see the disclosure of O'Brien U.S. Pat. No. 5,039,243, issued Aug. 13, 1991, the subject matter of which, with respect to crayon composition, is incorporated herein by reference.

The structural reinforcing sheath of flexible and cuttable material 20 can be made of a variety of polymeric plastic film or sheet materials. Such materials, well-known to the polymeric plastic industry include clear tubing, feeder tubes, co-extruded tubes, heat shrinkable tubing, etc. Suitable polymeric tubing materials can be obtained from companies such as the brand VisiPak® from Sinclair & Rush, Inc. of 13515 Parkway Avenue Drive, St. Louis, Mo. 63021-5880. Ideally, the packaging is clear packaging, polymeric plastic materials such as PEPG wrap material or other polyethylene, polypropylene, or in general alpha olefin polymeric materials. Currently the best choice material now known to the inventor is material sold under the trademark VisiPak® by Sinclair & Rush, Inc.

Colors, of course, may vary over a wide range. Likewise, the uses may vary over a wide range and need not be limited to crayons for children. They could include, for example, oil based pastels used for artist drawings, markers for erasable boards, etc. The colors can vary from all the primary colors to colors such as lemon yellow, yellow, yellow okra, pail orange, orange, brown, red, pink, pale blue, cobalt blue, ultra marine, green, yellow green, black, gray, white, etc., all without limitation.

The structurally reinforced sheath of flexible cutting material 20, as earlier indicated, may be clear plastic, colored plastic, if desired, and may be applied over a paper label 18 or applied directly to the crayon core 16 without paper label 18. Either way it successfully reinforces the integrity of the core crayon material 16 with increasing safety risk.

It therefore can be seen that the invention accomplishes at least all of its stated objectives.

What is claimed is:

1. A structurally reinforced crayon, comprising:

a core of crayon material;

a crayon label matingly surrounding some of the core of crayon material; and a structurally reinforcing transparent, axially continuous sheath of flexible and cuttable material surrounding at least a portion of said crayon material and said crayon label so that it structurally reinforces said crayon but can at the same time be cut away as said crayon is sharpened.

* * * * *